US008525634B2

(12) United States Patent
Ueda et al.

(10) Patent No.: US 8,525,634 B2
(45) **Date of Patent: *Sep. 3, 2013**

(54) CHIP VARISTOR

(75) Inventors: Kaname Ueda, Tokyo (JP); Katsunari Moriai, Tokyo (JP); Takahiro Itami, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/587,326

(22) Filed: Aug. 16, 2012

(65) Prior Publication Data

US 2013/0049923 A1 Feb. 28, 2013

(30) Foreign Application Priority Data

Aug. 29, 2011 (JP) ..... 2011-186176

(51) Int. Cl.
*H01C 7/10* (2006.01)

(52) U.S. Cl.
USPC ..... 338/20; 338/21

(58) Field of Classification Search
USPC ..... 338/20, 21
See application file for complete search history.

(56) References Cited

U.S. PATENT DOCUMENTS

| | | | | |
|---|---|---|---|---|
| 6,232,867 | B1 * | 5/2001 | Yoshida et al. | 338/21 |
| 6,400,253 | B1 * | 6/2002 | Jinno et al. | 338/332 |
| 7,649,435 | B2 | 1/2010 | Moriai et al. | |
| 7,724,123 | B2 | 5/2010 | Matsuoka et al. | |
| 7,864,025 | B2 * | 1/2011 | Katsumura et al. | 338/21 |
| 7,940,155 | B2 | 5/2011 | Katsumura et al. | |
| 7,994,894 | B2 | 8/2011 | Sato et al. | |
| 2012/0139688 | A1 * | 6/2012 | Ueda et al. | 338/21 |

FOREIGN PATENT DOCUMENTS

| | | | |
|---|---|---|---|
| JP | 1-93704 | * | 6/1989 |
| JP | A-2002-246207 | | 8/2002 |
| JP | A-2005-302937 | | 10/2005 |
| JP | 2006-344751 | * | 12/2006 |
| JP | 2009-277801 | * | 11/2009 |

OTHER PUBLICATIONS

Jan. 8, 2013 Office Action issued in Japanese Patent Application No. 2010-271326.
U.S. Appl. No. 13/295,606 in the name of Ueda et al., filed on Nov. 14, 2011.
U.S. Appl. No. 13/587,310 in the name of Ueda et al., filed on Aug. 16, 2012.
Apr. 29, 2013 Office Action issued in U.S. Appl. No. 13/587,310.
Jun. 12, 2013 Notice of Allowance issued in U.S. Appl. No. 13/295,606.
Mar. 1, 2013 Office Action issued in U.S. Appl. No. 13/295,606.

* cited by examiner

*Primary Examiner* — Kyung Lee
(74) *Attorney, Agent, or Firm* — Oliff & Berridge, PLC

(57) ABSTRACT

A chip varistor is provided with a varistor section, a plurality of electroconductive sections, and a plurality of terminal electrodes. The varistor section is comprised of a sintered body containing ZnO as a major component and is configured to exhibit the nonlinear voltage-current characteristics. The plurality of electroconductive sections are comprised of sintered bodies containing ZnO as a major component and arranged with the varistor section in between, and each electroconductive section has a first principal surface connected to the varistor section and a second principal surface opposed to the first principal surface. The plurality of terminal electrodes are connected respectively to the corresponding electroconductive sections. Each terminal electrode has a first electrode portion connected to the second principal surface and a second electrode portion connected to the first electrode portion.

7 Claims, 9 Drawing Sheets

CHIP VARISTOR

BACKGROUND OF THE INVENTION

1. Field of the Invention

The present invention relates to a chip varistor.

2. Related Background Art

One of known chip varistors is a multilayer chip varistor provided with a varistor element body having a varistor layer and internal electrodes arranged with the varistor layer in between, and also provided with terminal electrodes arranged at ends of the varistor element body so as to be connected to the corresponding internal electrodes (e.g., cf. Japanese Patent Application Laid-open No. 2002-246207). In the multilayer chip varistor, a region between the internal electrodes in the varistor layer functions as a region to exhibit the nonlinear voltage-current characteristics (hereinafter also referred to as "varistor characteristics").

SUMMARY OF THE INVENTION

In recent high-speed interfaces, the structure of IC itself is becoming weak against ESD (Electrostatic Discharge), in order to realize increase in speed. For this reason, there are increasing demands for countermeasures against ESD in high-speed transmission type IC and the aforementioned multilayer chip varistor is used as an ESD-resistant component. The ESD-resistant component for high-speed transmission system is required to have the essential feature of reduction in capacitance. If the component demonstrates a large capacitance, it will raise a problem in quality of signal and can cause failure in communication in the worst case.

A conceivable technique to reduce the capacitance of the multilayer chip varistor is to decrease the area of mutually overlapping portions of the internal electrodes arranged in contact with the varistor layer. The decrease in the area of the mutually overlapping portions of the internal electrodes leads to a decrease in a region to exhibit the capacitance, thereby to reduce the capacitance. However, when the area of the mutually overlapping portions of the internal electrodes (which will be referred to hereinafter as "overlap area") is small, there arises a new problem of reduction in tolerance against ESD (which will be referred to hereinafter as "ESD tolerance"). When a surge voltage like ESD is applied, an electric field distribution in the mutually overlapping portions of the internal electrodes is concentrated at edges of the mutually overlapping portions of the internal electrodes. If the electric field distribution in the mutually overlapping portions of the internal electrodes is concentrated at the edges, the ESD tolerance will suddenly decrease with decrease in the overlap area.

The multilayer chip varistor has the internal electrodes arranged in contact with the varistor layer, as described above. For this reason, it was difficult to maintain a sufficient ESD tolerance.

An object of the present invention is to provide a chip varistor capable of maintaining a sufficient ESD tolerance, without inclusion of the aforementioned internal electrodes.

The present invention provides a chip varistor comprising: a varistor section comprised of a sintered body containing ZnO as a major component and configured to exhibit the nonlinear voltage-current characteristics; a plurality of electroconductive sections comprised of sintered bodies containing ZnO as a major component and arranged with the varistor section in between, each electroconductive section having a first principal surface connected to the varistor section and a second principal surface opposed to the first principal surface; and a plurality of terminal electrodes connected to the plurality of electroconductive sections, wherein each of the terminal electrodes has a first electrode portion connected to the second principal surface, and a second electrode portion connected to the first electrode portion.

In the present invention, the varistor section to exhibit the varistor characteristics is located in between the electroconductive sections and connected thereto and, each of the terminal electrodes connected to the electroconductive sections has the first electrode portion and the second electrode portion. The chip varistor of the present invention, different from the aforementioned multilayer chip varistor, exhibits the varistor characteristics, without inclusion of the internal electrodes arranged in contact with the varistor layer. For this reason, even if a surge voltage like ESD is applied, the electric field distribution is not concentrated anywhere in the varistor section, so as to cause no reduction in ESD tolerance.

The chip varistor may be configured as follows: the varistor section includes a first region where at least one element selected from the group consisting of alkali metals, Ag, and Cu exists, and a second region extending between the first principal surfaces of the electroconductive sections and containing no element selected from the group consisting of alkali metals, Ag, and Cu; each of the electroconductive sections includes a first region where at least one element selected from the group consisting of alkali metals, Ag, and Cu exists, and a second region extending between the first principal surface and the second principal surface and containing no element selected from the group consisting of alkali metals, Ag, and Cu; the first electrode portion is connected to the second region in the electroconductive section.

The varistor section and the electroconductive sections comprised of the sintered bodies containing ZnO as a major component include their respective first regions where the at least one element selected from the group consisting of alkali metals, Ag, and Cu exists. In each of the varistor section and the electroconductive sections, the first region has the electric conductivity and relative permittivity lower than the second region containing no element selected from the group consisting of alkali metals, Ag, and Cu. The capacitance of the chip varistor can be represented by the sum of respective capacitances of the varistor section and the electroconductive sections located between the terminal electrodes. Therefore, since the varistor section and the electroconductive sections include the first regions, the respective capacitances of the varistor section and the electroconductive sections become lower, so as to achieve reduction in the capacitance of the chip varistor.

In general, terminal electrodes of an electronic component are formed by applying an electroconductive paste containing a metal and a glass component, onto an element body forming the electronic component, and sintering it. In this case, since the terminal electrodes contain the glass component, the coverage of the metal in the terminal electrodes over the element body can vary because of it. When the coverage of the metal varies in the terminal electrodes of the chip varistor, it can cause variation in the capacitance of the chip varistor.

When the terminal electrodes are formed using the electroconductive paste as described above, the electroconductive paste is applied so as to wrap around the end faces of the element body and portions of the side faces adjacent to the end faces. The terminal electrodes generally have portions formed so as to wrap around the side faces, and if there is variation in length of the portions, there will occur variation in the area covered by the metal in the terminal electrodes. In this case, the coverage of the metal will also vary, so as to cause variation in the capacitance of the chip varistor.

When the first region where the at least one element selected from the group consisting of alkali metals, Ag, and Cu exists is formed by diffusing the element from the exterior surfaces of the electroconductive sections on which the terminal electrodes are formed, the variation in length of the portions wrapping around the side faces of the terminal electrodes also leads to variation in size of the first regions. When there is variation in size of the first regions in the electroconductive sections as in this case, the capacitance of the chip varistor also varies.

In the chip varistor, as described above, the capacitance can vary because of the various factors. In contrast to it, the first electrode portion is connected to the second region in the electroconductive section, and thus it can suppress the variation in capacitance.

The first electrode portion may be arranged so as to cover the second principal surface. In this case, it is feasible to securely suppress the variation in capacitance.

The first electrode portion may be formed by co-firing an electroconductive paste containing a metal and containing no glass component, together with the varistor section and the plurality of electroconductive sections. In this case, it is feasible to securely suppress the variation in capacitance.

The chip varistor may be configured as follows: the varistor section contains at least one element selected from the group consisting of rare earth metals and Bi, as a minor component; the electroconductive sections are comprised of sintered bodies substantially containing none of the rare earth metals and Bi as a minor component. In this case, since the sintered bodies forming the electroconductive sections substantially contain none of the rare earth metals and Bi, they are unlikely to exhibit the varistor characteristics and they have relatively high electric conductivity. Therefore, the function as electrodes is not inhibited in the electroconductive sections. Since the varistor section and the electroconductive sections are comprised of the sintered bodies containing ZnO as a major component, connection strength becomes stronger at interfaces between the varistor section and the electroconductive sections. As a result, good connection is achieved between the varistor section and the electroconductive sections, which can prevent occurrence of delamination between the varistor section and the electroconductive sections.

The electroconductive sections may be comprised of a composite material of a metal and a metal oxide. In this case, heat in the chip varistor is readily dissipated through the electroconductive sections and therefore the chip varistor is obtained with excellent heat dissipation. Since the varistor section and the electroconductive sections contain the metal oxide, the connection strength becomes stronger at the interfaces between the varistor section and the electroconductive sections. As a result, good connection is achieved between the varistor section and the electroconductive sections, which can prevent occurrence of delamination between the varistor section and the electroconductive sections.

The first region of the varistor section may be located on the exterior surface side of the varistor section so as to surround an outer periphery of the second region of the varistor section, when viewed from a direction in which the varistor section is sandwiched in between the electroconductive sections. In this case, the electric conductivity is lower on the exterior surface side of the varistor section and surface current is less likely to flow on the exterior surface of the varistor section. As a result, it is feasible to suppress occurrence of leakage current.

The chip varistor may further comprise an electroconductive section arranged so that the first electrode portion is sandwiched in between the electroconductive sections. In this case, even if the first region where the at least one element selected from the group consisting of alkali metals, Ag, and Cu exists is formed by diffusing the element from the exterior surfaces of the electroconductive sections without formation of the terminal electrodes, the first electrode portions are surely connected to the second regions in the electroconductive sections.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be described below in detail with reference to the accompanying drawings. In the description the same elements or elements with the same functionality will be denoted by the same reference signs, without redundant description.

Figure 1:
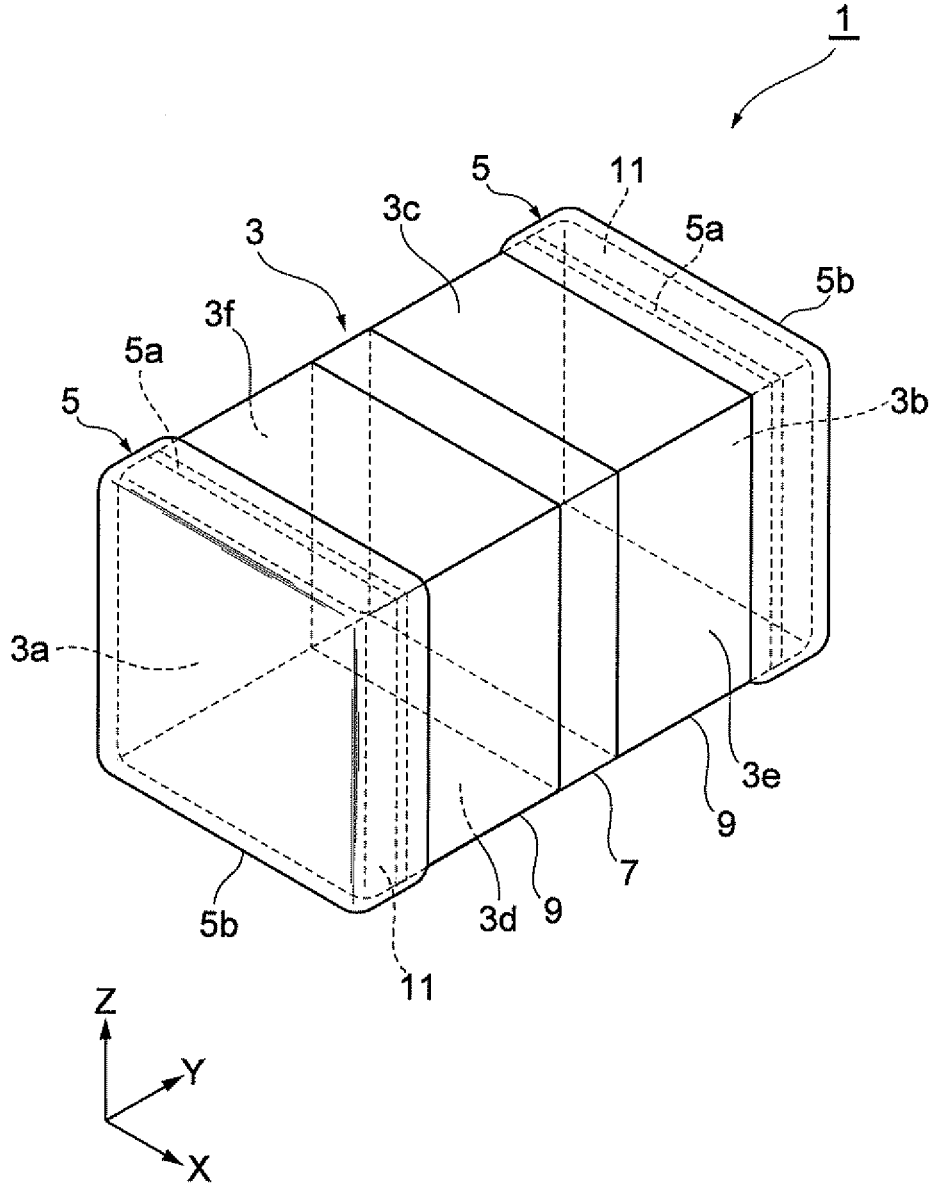
FIG. 1 is a perspective view illustrating the chip varistor according to an embodiment of the present invention.
Figure 2:
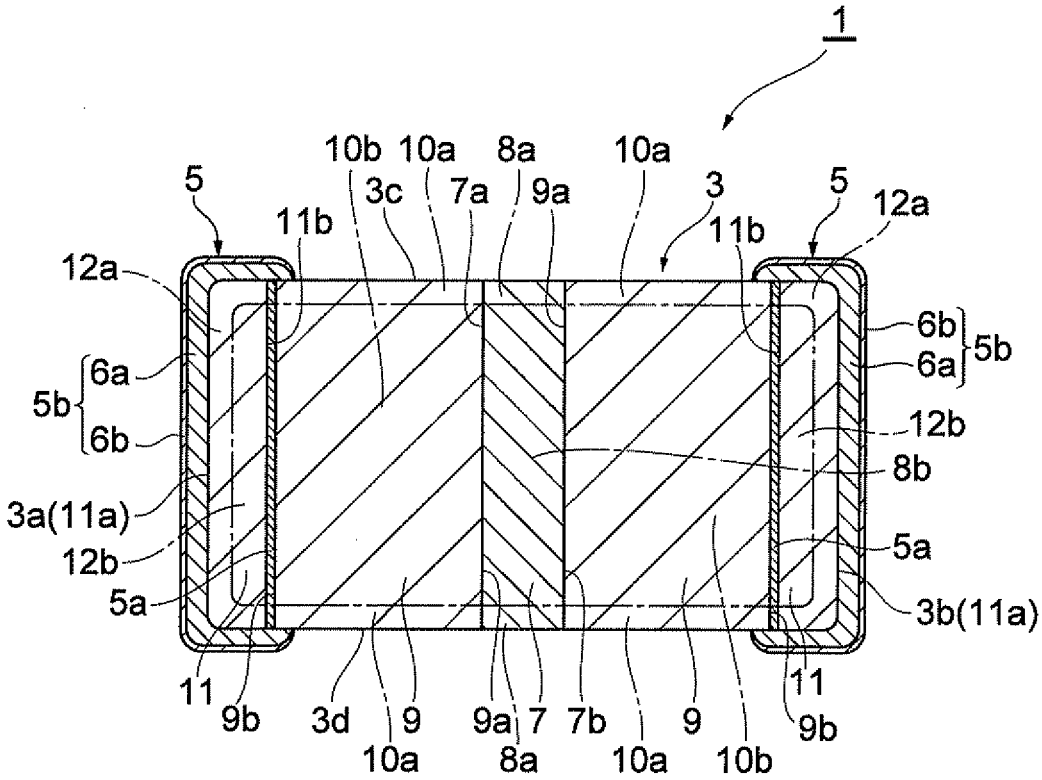
FIG. 2 is a drawing for explaining a cross-sectional configuration of the chip varistor according to the embodiment.
Figure 3:
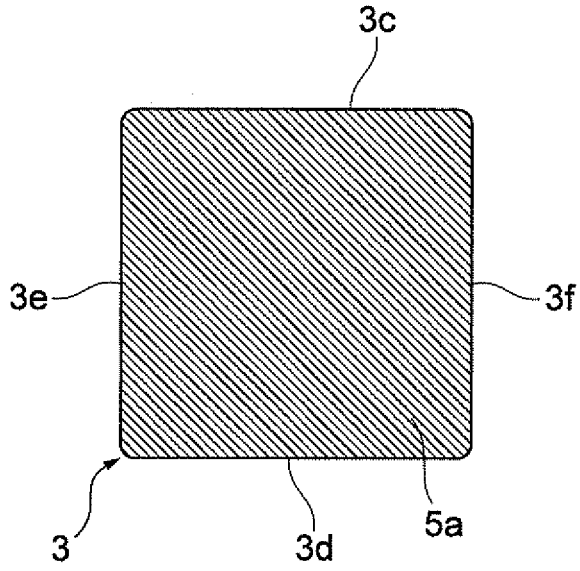
FIG. 3 is a drawing for explaining a cross-sectional configuration of a first electrode portion of the chip varistor according to the embodiment.
Figure 4:
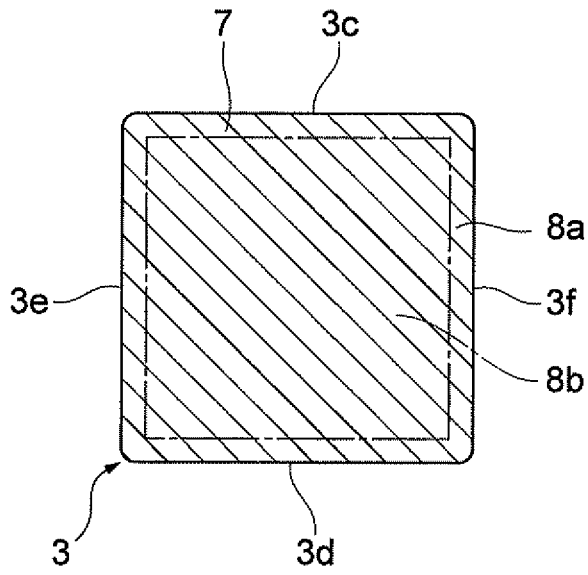
FIG. 4 is a drawing for explaining a cross-sectional configuration of a varistor section of the chip varistor according to the embodiment.
Figure 5:
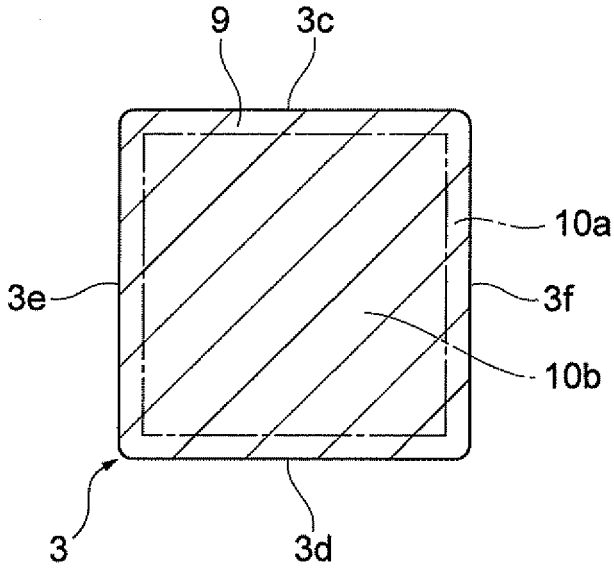
FIG. 5 is a drawing for explaining a cross-sectional configuration of a first electroconductive section of the chip varistor according to the embodiment.
Figure 6:
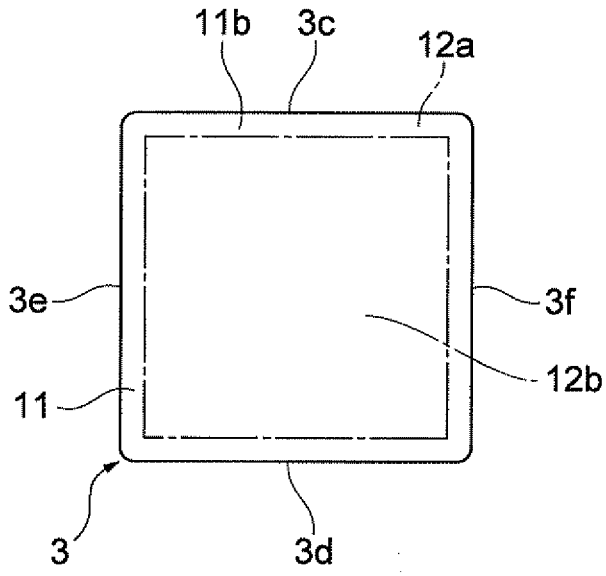
FIG. 6 is a drawing for explaining a configuration of a second electroconductive section of the chip varistor according to the embodiment.

First, a configuration of a chip varistor 1 according to an embodiment of the present invention will be described with reference to FIGS. 1-6. FIG. 1 is a perspective view illustrating the chip varistor according to the embodiment. FIG. 2 is a drawing for explaining a cross-sectional configuration of the chip varistor according to the embodiment. FIG. 3 is a drawing for explaining a cross-sectional configuration of a first electrode portion of the chip varistor according to the embodiment. FIG. 4 is a drawing for explaining a cross-sectional configuration of a varistor section of the chip varistor according to the embodiment. FIG. 5 is a drawing for explaining a cross-sectional configuration of a first electroconductive section of the chip varistor according to the embodiment. FIG. 6 is a drawing for explaining a configuration of a second electroconductive section of the chip varistor according to the embodiment.

The chip varistor 1, as shown in FIG. 1, is provided with an element body 3 of a nearly rectangular parallelepiped shape and a pair of terminal electrodes 5. The chip varistor 1 is, for example, a chip varistor of an extremely small size (so called 0402 size) having the length of 0.4 mm in the Y-direction, the height of 0.2 mm in the Z-direction, and the width of 0.2 mm in the X-direction in the drawing.

The element body 3 has a varistor section 7, a plurality of first electroconductive sections (two first electroconductive sections in the present embodiment) 9, and a plurality of second electroconductive sections (two second electroconductive sections in the present embodiment) 11. The element body 3 has end faces 3*a*, 3*b* of a square shape opposed to each other, and four side faces 3*c*-3*f* perpendicular to the end faces 3*a*, 3*b*, as its exterior surface. The four side faces 3*c*-3*f* extend so as to connect the end faces 3*a*, 3*b*.

The varistor section 7, as shown in FIGS. 1 and 2, is a part of a rectangular parallelepiped shape located nearly in the center of the element body 3 and is comprised of a sintered body (semiconductor ceramic) to exhibit the varistor characteristics. The varistor section 7 includes a pair of principal surfaces 7*a*, 7*b* opposed to each other in its thickness direction (or the Y-direction in the drawing). The thickness of the varistor section 7 is set, for example, in the range of about 5 to 200 μm.

The varistor section 7 contains ZnO (zinc oxide) as a major component and also contains minor components of metals such as Co, rare earth metals, Group IIIb elements (B, Al, Ga, In), Si, Cr, Mo, alkali metals (K, Rb, Cs), and alkaline-earth metals (Mg, Ca, Sr, Ba), or oxides thereof. In the present embodiment the varistor section 7 contains Co, Pr, Cr, Ca, K, and Al as minor components. There are no particular restrictions on the content of ZnO in the varistor section 7, but it is usually from 99.8 to 69.0% by mass when the total content of all materials constituting the varistor section 7 is 100% by mass.

The rare earth metal (e.g., Pr) acts as a substance to exhibit the varistor characteristics. The content of the rare earth metal in the varistor section 7 is set, for example, in the range of about 0.01 to 10 atomic %.

The first electroconductive sections 9, as shown in FIGS. 1 and 2, are parts of a nearly rectangular parallelepiped shape. The first electroconductive sections 9 are arranged on both sides of the varistor section 7 with the varistor section 7 in between. The first electroconductive sections 9 have respective principal surfaces 9*a* connected to the varistor section 7 (principal surface 7*a* or 7*b*), and respective principal surfaces 9*b* opposed to the corresponding principal surfaces 9*a*. In the present embodiment, the principal surfaces 7*a*, 7*b* of the varistor section 7 are almost entirely in contact with the principal surfaces 9*a* of the first electroconductive sections 9 to be connected thereto. The principal surfaces 9*a* of the first electroconductive sections 9 have the shape nearly identical to that of the principal surfaces 7*a*, 7*b* of the varistor section 7. The principal surfaces 9*a* of the first electroconductive sections 9 function as electrode faces to the varistor section 7.

The second electroconductive sections 11, as shown in FIGS. 1 and 2, are parts of a nearly rectangular parallelepiped shape located in regions nearer to the two ends of the element body 3. The second electroconductive sections 11 have respective principal surfaces 11*a* constituting the end faces 3*a*, 3*b* of the element body 3, and respective principal surfaces 11*b* opposed to the corresponding principal surfaces 11*a*.

The first and second electroconductive sections 9, 11 are comprised of sintered bodies containing ZnO as a principal component. The resistivity of ZnO is from 1 to 10 Ω·cm and thus ZnO has relatively high electrical conductivity. For this reason, the first electroconductive sections 9 function as electrodes. The first and second electroconductive sections 9, 11 may contain metals such as Co, Group IIIb elements (B, Al, Ga, In), Si, Cr, Mo, alkali metals (K, Rb, Cs), and alkaline-earth metals (Mg, Ca, Sr, Ba) or oxides thereof as minor components, for adjustment of resistivity. There are no particular restrictions on the content of ZnO in the first and second electroconductive sections 9, 11, but it is, for example, from 100 to 69.0% by mass when the total content of materials constituting the first and second electroconductive sections 9, 11 is 100% by mass.

If the first electroconductive sections 9 should substantially contain a rare earth metal, the first electroconductive sections 9 could exhibit the varistor characteristics. For this reason, the first electroconductive sections 9 preferably substantially contain no rare earth metal. When the first electroconductive sections 9 substantially contain no rare earth metal, they are unlikely to exhibit the varistor characteristics. Therefore, the first electroconductive sections 9 have low electric resistance and relatively high electrical conductivity. The state in which "the electroconductive sections substantially contain no rare earth metal" refers to a state in which any rare earth metal was not intentionally added in raw materials in preparing the materials constituting the first electroconductive sections 9. For example, a case such that one or more of rare earth metals are contained unintentionally because of diffusion from the varistor section 7 into the first electroconductive sections 9 corresponds to the state in which "the first electroconductive sections 9 substantially contain no rare earth metal." In the present embodiment, the second electroconductive sections 11 substantially contain no rare earth metal.

Each of the terminal electrodes 5 has a first electrode portion 5*a* and a second electrode portion 5*b*. The first electrode portion 5*a* of each terminal electrode 5 is arranged between the first electroconductive section 9 and the second electroconductive section 11. Each second electrode portion 5*b* is connected to the first electrode portion 5*a* and the second electrode portions 5*b* are arranged at the two ends of the element body 3.

The first electrode portion 5*a* is connected directly to the principal surface 9*b* of the first electroconductive section 9 and connected directly to the principal surface 11*b* of the second electroconductive section 11. Namely, the first electrode portion 5*a* is located in between the first electroconductive section 9 and the second electroconductive section 11. The first electrode portion 5*a* is formed so as to cover the entire area of the principal surface 9*b* of the first electroconductive section 9 and the entire area of the principal surface 11*b* of the second electroconductive section 11. Namely, the first electrode portion 5*a*, as shown in FIG. 3, has a nearly rectangular shape. The edges of the first electrode portion 5*a* are exposed in the four side faces 3*c*-3*f* of the element body 3. The first electrode portion 5*a* is comprised of a metal (e.g., Pd, Ag, or an Ag—Pd alloy). The first electrode portion 5*a* is constructed as a sintered body of an electroconductive paste containing a powder consisting of the foregoing metal, an organic binder, and an organic solvent. The electroconductive paste for formation of the first electrode portion 5*a* contains no glass component (e.g., such as glass frit).

The second electrode portions 5*b* are formed in a multilayer form so as to cover the respective end faces 3*a*, 3*b* of the element body 3 (principal surfaces 11*a* of the second electroconductive sections 11) and portions of the four side faces 3*c*-3*f* nearer to the respective end faces 3*a*, 3*b*. Each of the second electrode portions 5*b* is formed so as to also cover the edges of the first electrode portion 5*a* exposed in the four side faces 3*c*-3*f* of the element body 3 and therefore is connected directly to the first electrode portion 5*a*. Each second electrode portion 5*b* includes a first electrode layer 6*a* and a second electrode layer 6*b*.

The first electrode layers 6*a* are formed by applying an electroconductive paste onto the surface of the element body 3 and sintering it. Namely, the first electrode layers 6*a* are sintered electrode layers. The electroconductive paste used herein is one obtained by mixing a glass component, an organic binder, and an organic solvent in a powder consisting of a metal (e.g., Pd, Cu, Ag, or an Ag—Pd alloy). The second electrode layers 6*b* are formed by plating on the corresponding first electrode layers 6*a*. In the present embodiment, each second electrode layer 6*b* includes an Ni-plated layer formed by Ni plating on the first electrode layer 6*a*, and an Sn-plated layer formed by Sn plating on the Ni-plated layer.

Each of the varistor section 7, the first electroconductive sections 9, and the second electroconductive sections 11, as also shown in FIGS. 4-6, includes a first region 8*a*, 10*a*, 12*a* and a second region 8*b*, 10*b*, 12*b*, respectively. The first regions 8*a*, 10*a*, 12*a* contain at least one element selected from the group consisting of alkali metals, Ag, and Cu. In the first regions 8*a*, 10*a*, 12*a*, the at least one element selected from the group consisting of alkali metals, Ag, and Cu exists in a solid solution form in crystal grains of ZnO or exists at crystal grain boundaries of ZnO. In the second regions 8*b*, 10*b*, 12*b*, there is no element selected from the group consisting of alkali metals, Ag, and Cu. In the present embodiment, the foregoing element to be used is an alkaline metal, particularly, Li. Li has the relatively small ion radius, is easy to form a solid solution in crystal grains of ZnO, and also has a high diffusion rate. In the first regions 8*a*, 10*a*, 12*a*, there may be two or more elements selected from the group consisting of alkali metals, Ag, and Cu.

In the varistor section 7, the second region 8*b* is located nearly in the center of the varistor section 7, when viewed from the opposing direction of the pair of principal surfaces 7*a*, 7*b*, as shown in FIG. 4. The second region 8*b* extends between the principal surface 7*a* and the principal surface 7*b*, when viewed from a direction perpendicular to the opposing direction of the pair of principal surfaces 7*a*, 7*b*. Namely, the second region 8*b* extends between the principal surfaces 9*a* of the first electroconductive sections 9 to be connected to the first electroconductive sections 9 (principal surfaces 9*a*). The first region 8*a* is located on the exterior surface side of the varistor section 7 so as to surround the outer periphery of the second region 8*b*, when viewed from the opposing direction of the pair of principal surfaces 7*a*, 7*b*.

In each of the first electroconductive sections 9, the second region 10*b* is located nearly in the center of the first electroconductive section 9, when viewed from the opposing direction of the pair of principal surfaces 9*a*, 9*b*, as shown in FIG. 5. The second region 10*b* extends between the principal surface 9*a* and the principal surface 9*b*, when viewed from the direction perpendicular to the opposing direction of the pair of principal surfaces 9*a*, 9*b*. Namely, the second region 10*b* is connected to the second region 8*b* of the varistor section 7 and to the first electrode portion 5*a*. The first region 10*a* is located on the exterior surface side of the first electroconductive section 9 so as to surround the outer periphery of the second region 10*b*, when viewed from the opposing direction of the pair of principal surfaces 9*a*, 9*b*.

In each of the second electroconductive sections 11, the second region 12*b* is located nearly in the center of the second electroconductive section 11, when the principal surface 11*b* is viewed from the direction perpendicular to the principal surface 11*b*, as shown in FIG. 6. The second region 12*b* does not reach the principal surface 11*a*, when viewed from a direction perpendicular to the opposing direction of the pair of principal surfaces 11*a*, 11*b*. The second region 12*b* is connected to the first electrode portion 5*a*. The first region 12*a* is located on the exterior surface side of the second electroconductive section 11 so as to surround the outer periphery of the second region 12*b*.

When the element selected from the group consisting of alkali metals, Ag, and Cu exists in the solid solution form in the crystal grains of ZnO, the element reduces donors in ZnO demonstrating the property as an n-type semiconductor. For this reason, ZnO comes to have lower electric conductivity and becomes less likely to exhibit the varistor characteristics. It is also considered that the electric conductivity becomes lower when the foregoing element exists at crystal grain boundaries of ZnO. Therefore, the first regions 8*a*, 10*a*, 12*a* have lower electric conductivity and lower capacitance than the second regions 8*b*, 10*b*, 12*b*.

In the varistor section 7, the second region 8*b* functions mainly as a region to exhibit the varistor characteristics. In the first electroconductive sections 9, the second regions 10*b* function mainly as electrodes (conductors). The first electrode portions 5*a* are connected directly to the corresponding second regions 10*b* functioning as electrodes. This causes the second region 10*b* of each first electroconductive section 9 to be electrically connected through the first electrode portion 5*a* to the second electrode portion 5*b*.

Figure 7:
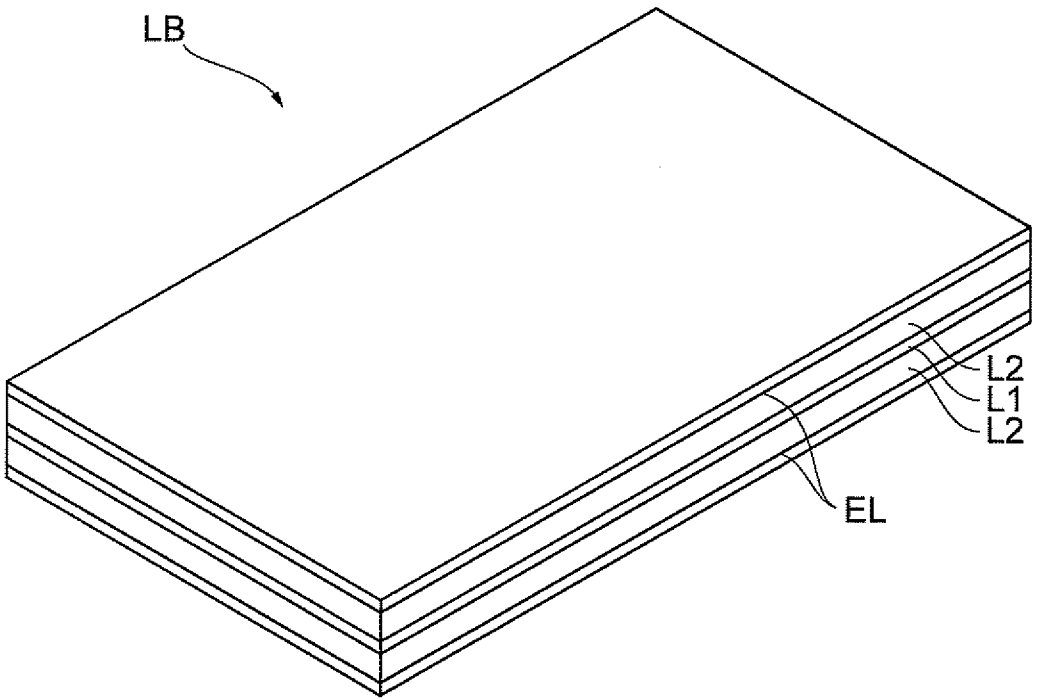
FIG. 7 is a drawing for explaining a manufacturing process of the chip varistors according to the embodiment.
Figure 8:
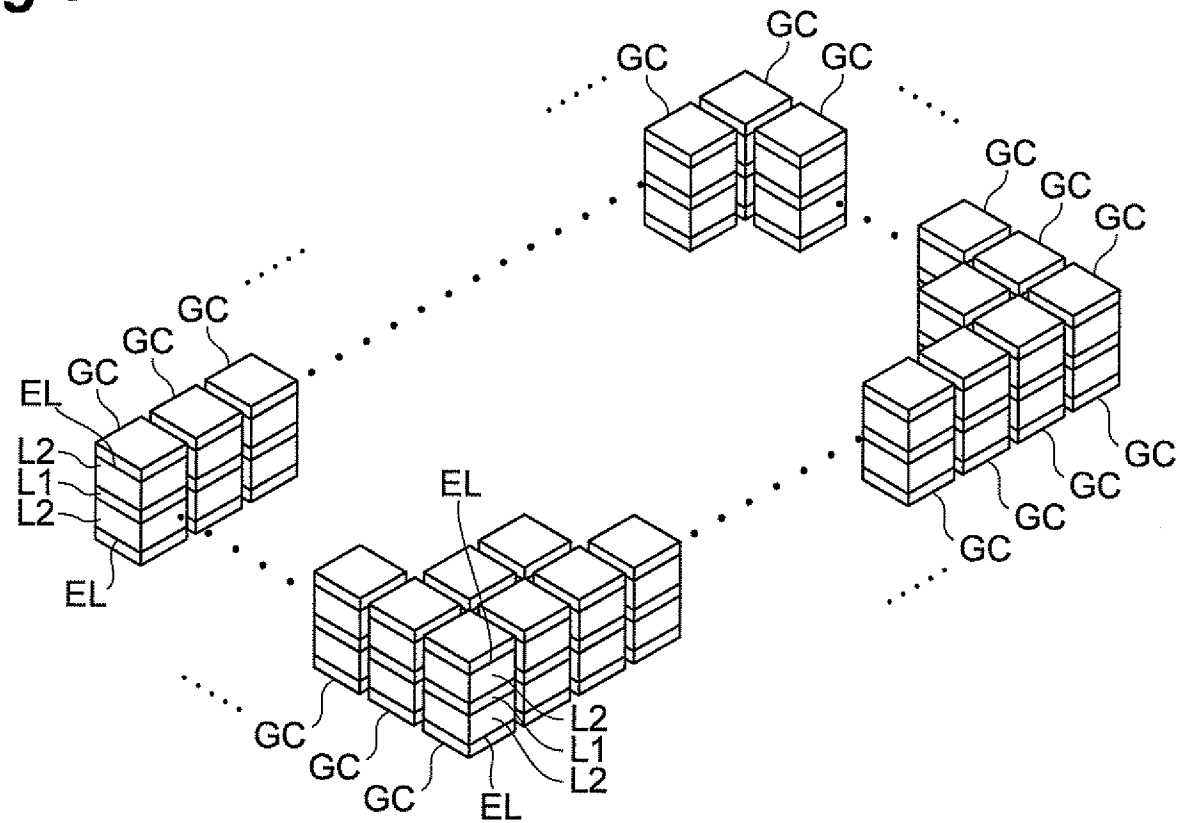
FIG. 8 is a drawing for explaining the manufacturing process of the chip varistors according to the embodiment.

An example of a manufacturing process of chip varistors 1 having the above-described configuration will be described below with reference to FIGS. 7 and 8. FIGS. 7 and 8 are drawings for explaining the manufacturing process of the chip varistors according to the embodiment.

First, ZnO as the major component of the varistor section 7, and the trace additives such as metals or oxides of Co, Pr, Cr, Ca, K, and Al each are weighed at a predetermined ratio and then these components are mixed to prepare a varistor material. Thereafter, further additives such as an organic binder, an organic solvent, and an organic plasticizer are added in this varistor material and they are mixed and pulverized with a ball mill or the like to obtain a slurry. This slurry is applied onto films, e.g., of polyethylene terephthalate by a known method such as the doctor blade method, and dried to form membranes in a predetermined thickness (e.g., about 30 μm). The membranes obtained as described above are peeled off from the films to obtain first green sheets.

Furthermore, additives such as an organic binder, an organic solvent, and an organic plasticizer are added in the component of ZnO of the first and second electroconductive sections 9, 11, and they are mixed and pulverized with a ball mill or the like to obtain a slurry. When the first and second electroconductive sections 9, 11 are made to contain the aforementioned minor components in addition to ZnO, ZnO and additives constituting the minor components are weighed at a predetermined ratio and then the components are mixed to prepare a material for the first and second electroconductive sections 9, 11. Further additives such as an organic binder, an organic solvent, and an organic plasticizer are added in the material for the first and second electroconductive sections 9, 11 and they are mixed and pulverized with a ball mill or the like to obtain a slurry. This slurry is applied onto films, e.g., of polyethylene terephthalate by a known method such as the doctor blade method, and then dried to form membranes in a predetermined thickness (e.g., about 30 μm). The membranes obtained in this manner are peeled off from the films to obtain second green sheets.

Next, electrode patterns corresponding to the first electrode portions 5*a* are formed on the second green sheets. The electrode patterns corresponding to the first electrode portions 5*a* are formed by printing patterns of an electroconductive paste as a mixture of a powder consisting of the aforementioned metal, an organic binder, and an organic solvent, by a printing method such as screen printing, and drying it. The powder consisting of the metal contains, for example, Pd, Ag, or an Ag—Pd alloy as a major component.

The next process is to stack the first green sheets, the second green sheets with the aforementioned electrode patterns formed thereon, and the second green sheets without formation of the electrode patterns, each by a predetermined number. In this process, a varistor green layer consisting of the first green sheets and conductor green layers each consisting of the second green sheets without formation of the electrode patterns are stacked so that the varistor green layer is sandwiched in between the conductor green layers. The second green sheets with the electrode patterns formed thereon are stacked so as to be sandwiched in between conductor green layers. Thereafter, the stacked green sheets are pressed under pressure so that the green sheets become bonded to each other. The thickness of the varistor green layer is adjusted by the number of first green sheets. The thickness of the conductor green layers is adjusted by the number of second green sheets. The number of first green sheets may be at least one. The number of second green sheets with the electrode patterns thereon may also be at least one.

The above processes result in preparing a laminate body LB in which the varistor green layer L1, the conductor green layers L2, and the electrode patterns EL are stacked together, as shown in FIG. 7.

Next, the laminate body LB is dried and thereafter, as shown in FIG. 8, it is cut in chip units to obtain a plurality of green element bodies GC (element bodies 3 before fired). The cutting of the laminate body LB is performed, for example, with a dicing saw or the like.

Next, the plurality of green element bodies GC are subjected to a thermal treatment under predetermined conditions (e.g., 180-400° C. and 0.5 to 24 hours) to implement debindering, and thereafter further fired under predetermined conditions (e.g., 1000-1400° C. and 0.5 to 8 hours). This firing process results in turning the varistor green layer L1 of the first green sheets into the varistor section 7, turning the conductor green layers L2 of the second green sheets into the first or second electroconductive sections 9, 11, and turning the electrode patterns EL into the first electrode portions 5*a*, thereby obtaining a plurality of element bodies 3 in each of which the varistor section 7 is sandwiched in between the first electroconductive sections 9 and the first electrode portions 5*a* is sandwiched in between the first electroconductive sections 9 and the second electroconductive sections 11. The varistor green layer L1, the conductor green layers L2, and the electrode patterns EL are fired together. After the firing process, the element bodies 3 may be polished by barrel polishing if necessary. The barrel polishing may be carried out before the firing, i.e., after the cutting of the laminate body LB.

Next, at least one element selected from the group consisting of alkali metals (e.g., Li, Na, and so on), Ag, and Cu is diffused from the exterior surface of the element body 3 (the pair of end faces 3*a*, 3*b* and the four side faces 3*c*-3*f*). The below will describe an example of diffusion of an alkali metal element.

First, an alkali metal compound is attached to the exterior surface of the element body 3. The attachment of the alkali metal compound can be implemented using a hermetically-closed rotary pot. There are no particular restrictions on the alkali metal compound, but it is a compound that can diffuse the alkali metal from the surface of the element body 3 when subjected to a thermal treatment, and can be an oxide, a hydroxide, a chloride, a nitrate, a borate, a carbonate, an oxalate, or the like of the alkali metal.

Then the element body 3 with the alkali metal compound attached thereto is thermally treated at a predetermined temperature and for a predetermined time in an electric furnace. This thermal treatment results in diffusing the alkali metal from the alkali metal compound through the exterior surface of the element body 3 into the interior. A preferred thermal treatment temperature is from 700° C. to 1000° C. and a thermal treatment atmosphere is the atmosphere. A thermal treatment time (retention time) is preferably from 10 minutes to 4 hours.

The portions in the element body 3 (varistor section 7 and first and second electroconductive sections 9, 11) where the alkali metal element has diffused, i.e., the first regions 8*a*, 10*a*, 12*a* where the alkali metal element exists, come to have higher resistance and lower capacitance as described above. In the present embodiment, the alkali metal element diffuses through the end faces 3*a*, 3*b*, but it does not inhibit the electrical connection between the terminal electrodes 5 and the first electroconductive sections 9 (second regions 10*b*) because of the existence of the second electroconductive sections 11.

Next, an electroconductive paste is applied so as to cover the two end faces 3*a*, 3*b* of each element body 3 and thermally treated to sinter the electroconductive paste on the element body 3 to form the first electrode layers 6*a* of the second electrode portions 5*b*. Thereafter, electroplating treatments such as Ni plating and Sn plating are carried out so as to cover the first electrode layers 6*a*, thereby forming the second electrode layers 6*b*. These result in forming the terminal electrodes 5 on the both end sides of the element body 3. The terminal electrodes 5 are formed on both end sides in the direction in which the varistor section 7 is sandwiched in between the first electroconductive sections 9, in the element body 3. The electroconductive paste for formation of the first electrode layers 6*a* can be, for example, one in which a glass frit and an organic vehicle are mixed in a metal powder. The metal powder can be, for example, one containing Cu, Ag, or an Ag—Pd alloy as a major component.

The chip varistors 1 are obtained through these processes.

In the present embodiment, the varistor section 7 is sandwiched in between the first electroconductive sections 9 and connected thereto, and the varistor section 7, particularly, the second region Sb of the varistor section 7 functions mainly as a region to exhibit the varistor characteristics. The chip varistor 1, different from the so-called multilayer chip varistor, exhibits the varistor characteristics, without inclusion of the internal electrodes arranged in contact with the varistor layer. For this reason, even if a surge voltage like ESD is applied, the electric field distribution will not be concentrated anywhere in the varistor section 7, so as to cause no reduction in ESD tolerance.

In the present embodiment, the varistor section 7 and the first electroconductive sections 9 include the first regions 8*a*, 10*a*, respectively. The first regions 8*a*, 10*a* have the electric conductivity and relative permittivity lower than the second regions 8*b*, 10*b*. The capacitance of the chip varistor 1 can be represented by the sum of respective capacitances of the varistor section 7 and the first electroconductive sections 9 located between the first electrode portions 5*a* of the terminal electrodes 5. Therefore, since the varistor section 7 and the first electroconductive sections 9 include the first regions 8*a*, 10*a*, the respective capacitances of the varistor section 7 and the first electroconductive sections 9 become lower, so as to achieve reduction in the capacitance of the chip varistor 1.

In the multilayer chip varistor, the area of the mutually overlapping portions of the internal electrodes can vary because of such factors as accuracy of formation of the electrode patterns on the varistor green sheets, deviation of stacking of the varistor green sheets, or deviation of cutting of the laminate body. The variation in the area of the mutually overlapping portions of the internal electrodes will lead to variation in the capacitance established by the mutually overlapping portions of the internal electrodes. In contrast to it, the chip varistor 1 includes no internal electrodes, as described above, so as to cause no variation in capacitance due to the internal electrodes.

In general, terminal electrodes of an electronic component are formed by applying an electroconductive paste containing a metal and a glass component, onto an element body and thereafter sintering it. In this case, since the terminal electrodes contain the glass component, the coverage of the metal in the terminal electrodes over the element body can vary because of it. When the coverage of the metal varies in the terminal electrodes of the chip varistor, there occurs variation in the capacitance of the chip varistor.

When the terminal electrodes are formed using the electroconductive paste, the electroconductive paste is applied so as to wrap around the end faces of the element body and portions of the side faces adjacent to the end faces. The terminal electrodes have the portions formed so as to wrap around the side faces, and if there occurs variation in length of the portions, there will also arise variation in the area covered by the metal. In this case, the coverage of the metal will also vary, so as to cause variation in the capacitance of the chip varistor.

In the chip varistor, as described above, the capacitance can vary because of the various factors. In the present embodiment, however, the first electrode portions 5*a* are connected to the corresponding second regions 10*b* in the first electroconductive sections 9, which can suppress occurrence of variation in the capacitance of the chip varistor 1.

Each first electrode portion 5*a* is arranged so as to cover the entire area of the principal surface 9*b* of the first electroconductive section 9. This configuration enables secure suppression of the variation in the capacitance of the chip varistor 1.

The first electrode portions 5*a* are formed by co-firing the electroconductive paste containing the metal and containing no glass component, together with the varistor section 7 and the electroconductive sections 9, 11. Since the first electrode portions 5*a* contain no glass component, the coverage of the metal in the first electrode portions 5*a* is less likely to vary. This enables secure suppression of the variation in the capacitance of the chip varistor 1.

The first electrode portions 5*a* are formed by co-firing the electroconductive paste containing the powder consisting of the metal and containing no glass component, together with the varistor section 7 and the first and second electroconductive sections 9, 11. This also enables secure suppression of the variation in the capacitance of the chip varistor 1.

In the present embodiment, the first region 8*a* of the varistor section 7 is located on the exterior surface side of the varistor section 7 so as to surround the outer periphery of the second region 8*b*, when viewed from the opposing direction of the pair of principal surfaces 7*a*, 7*b*. Since the electric conductivity is lower on the exterior surface side of the varistor section 7, surface current is less likely to flow on the exterior surface of the varistor section 7. As a result, occurrence of leakage current is suppressed in the chip varistor 1.

In the present embodiment, since the varistor section 7 and the first electroconductive sections 9 are comprised of the sintered bodies containing ZnO as a major component, the connection strength becomes stronger at the interfaces between the varistor section 7 and the first electroconductive sections 9. This results in achieving good connection between the varistor section 7 and the first electroconductive sections 9, which can suppress occurrence of delamination between the varistor section 7 and the first electroconductive sections 9.

In the present embodiment, the first electroconductive sections 9 are comprised of the sintered bodies containing ZnO as a major component and substantially not containing the rare earth metal which the varistor section 7 contains as a minor component. Since the first electroconductive sections 9 (sintered bodies) substantially contain no rare earth metal, they are unlikely to exhibit the varistor characteristics and have relatively high electric conductivity. Therefore, the function as electrodes is not inhibited in the first electroconductive sections 9.

In the present embodiment, at least one element selected from the group consisting of alkali metals, Ag, and Cu is diffused from the exterior surface of the element body 3 (end faces 3*a*, 3*b* and side faces 3*c*-3*f*). For this reason, it is easy to control the range of diffusion of the at least one element selected from the group consisting of alkali metals, Ag, and Cu.

In the present embodiment, each second electroconductive section 11 is arranged so that the first electrode portion 5*a* is sandwiched in between the first electroconductive section 9 and the second electroconductive section 11. For this reason, even in the case where the aforementioned element is diffused from the end faces 3*a*, 3*b* of the element body 3 to form the first regions 12*a* where the at least one element selected from the group consisting of alkali metals, Ag, and Cu exists, the element is unlikely to reach the first electrode portions 5*a* from the end faces 3*a*, 3*b*. As a result, the first electrode portions 5*a* are securely connected to the second regions 10*b* in the first electroconductive sections 9.

Figure 9:
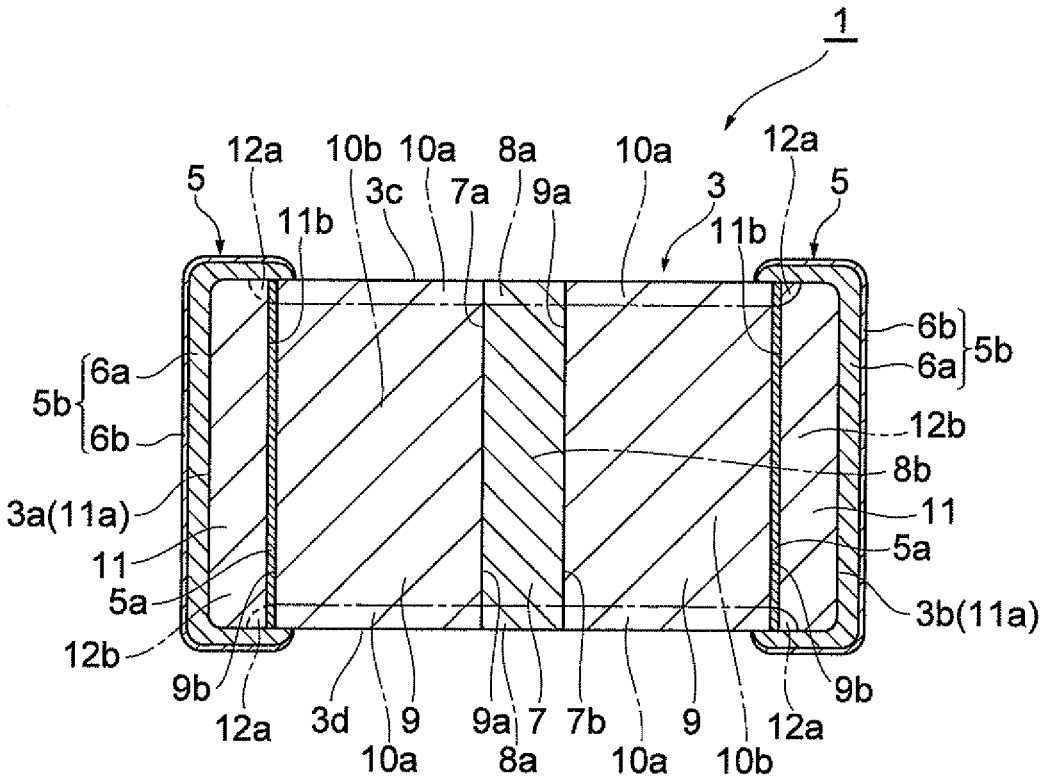
FIG. 9 is a drawing for explaining a cross-sectional configuration of the chip varistor according to a modification example of the embodiment.

A configuration of chip varistor 1 according to a modification example of the present embodiment will be described below with reference to FIG. 9. FIG. 9 is a drawing illustrating a sectional configuration of the chip varistor according to the modification example of the present embodiment.

The chip varistor 1 according to the present modification example is also provided with the element body 3 of a nearly rectangular parallelepiped shape, and the pair of terminal electrodes 5. The chip varistor 1 of the present modification example is different in the sizes of the first and second regions 12*a*, 12*b* of the second electroconductive sections 11, from the chip varistor 1 of the aforementioned embodiment.

In each of the second electroconductive sections 11, the second region 12*b* is located nearly in the center of the second electroconductive section 11, when viewed from the opposing direction of the pair of principal surfaces 11*a*, 11*b*, as the second region 10*b* of each first electroconductive section 9 is. The second region 12*b* extends between the principal surface 11*a* and the principal surface 11*b*, when viewed from the direction perpendicular to the opposing direction of the paired principal surfaces 11*a*, 11*b*. The second region 12*b* is connected to the first electrode portion 5*a* and the second electrode portion 5*b* (first electrode layer 6*a*). The first region 12*a* is located on the exterior surface side of the second electroconductive section 11 so as to surround the outer periphery of the second region 12*b*, when viewed from the opposing direction of the pair of principal surfaces 11*a*, 11*b*.

The below will describe an example of a manufacturing process of chip varistors 1 according to the present modification example shown in FIG. 9. The process up to production of a plurality of element bodies 3 is the same as in the manufacturing process of the chip varistors 1 of the aforementioned embodiment and thus the description thereof is omitted herein.

After the plurality of element bodies 3 are obtained, an electroconductive paste is applied so as to cover the two end faces 3*a*, 3*b* of each element body 3 and a thermal treatment is carried out to sinter the electroconductive paste on each element body 3, to form the first electrode layers 6*a* of the second electrode portions 5*b*. Thereafter, electroplating processes such as Ni plating and Sn plating are carried out so as to cover the first electrode layers 6*a*, thereby to form the second electrode layers 6*b*.

The next process is to diffuse at least one element selected from the group consisting of alkali metals (e.g., Li, Na, and so on), Ag, and Cu, from the exposed surface of the element body 3 (four side faces 3*c*-3*f*). A technique of diffusing the at least one element selected from the group consisting of alkali metals, Ag, and Cu is the same as the technique in the aforementioned embodiment.

The chip varistors 1 according to the present modification example are obtained through these processes.

The present modification example also achieves reduction in capacitance while maintaining a sufficient ESD tolerance, and securely prevents the variation in capacitance, as the aforementioned embodiment did.

The chip varistors 1 of the embodiment and the modification example are mounted by soldering so that the opposing direction of the first electroconductive sections 9 becomes parallel to a mount surface of an external substrate or the like. Since the varistor section 7 is located approximately in the center of the element body 3 when viewed in the opposing direction of the first electroconductive sections 9, solder is less likely to reach the varistor section 7 during the soldering. As a result, the chip varistor 1 can prevent the solder from attaching to the varistor section 7 and inhibiting the function of the varistor section 7, during the solder mounting.

The above described the preferred embodiments of the present invention, but it should be noted that the present invention is not always limited to the above-described embodiments but may be modified in may ways without departing from the scope and spirit of the invention.

The first and second electroconductive sections 9, 11 may be comprised of a composite material of a metal (e.g., an Ag—Pd alloy, Ag, Au, Pd, or Pt) and a metal oxide (e.g., ZnO, CoO, NiO, or $TiO_2$). In this case, the metal is dispersed in the metal oxide and the metal forms conductive passages connecting between the first electrode portions 5*a* and the varistor section 7. The content of the metal oxide is, for example, in the range of 10 to 80% by mass when the total content of materials constituting each electroconductive section 9, 11 is 100% by mass. The content of the metal in each electroconductive section 9, 11 is, for example, in the range of 20 to 90% by mass when the total content of the materials constituting each electroconductive section 9, 11 is 100% by mass. The metal oxide is preferably ZnO which is the same as the metal oxide contained in the varistor section 7.

Each first electrode portion 5*a* does not always have to be formed so as to cover the entire area of the principal surface 9*b* of the first electroconductive section 9. However, in order to suppress the variation in the capacitance of the chip varistor 1, each first electrode portion 5*a* preferably covers at least a region of the principal surface 9*b* corresponding to the second region 10*b*. It is a matter of course that, for connection to the second electrode portion 5*b*, at least a part of each first electrode portion 5*a* needs to be exposed in the four side faces 3*c*-3*f* of the element body 3. The first electrode portion 5*a* may be composed of a plurality of segments.

The element body 3 may be constructed without the second electroconductive sections 11. In this case, the first electrode portion 5*a* and the second electrode portion 5*b* are connected directly to each other. When the element body 3 is constructed without the second electroconductive sections 11, it is preferable to diffuse the at least one element selected from the group consisting of alkali metals, Ag, and Cu, after the formation of the second electrode portions 5*b* on the element body 3. By this process, each first electrode portion 5*a* is surely connected through the second region 10*b* of the first electroconductive section 9 to the second region 8*b* of the varistor section 7.

The varistor section 7 may contain Bi, instead of the rare earth metal. In this case, the first electroconductive sections 9 preferably do not contain Bi, as described above. The varistor section 7 may contain the rare earth metal and Bi. In this case, the first electroconductive sections 9 preferably contain neither of the rare earth metal and Bi.

In the embodiment and the modification example of the present invention the first regions 8*a*, 10*a*, 12*a* are located on the exterior surface side of the element body 3 so as to surround the outer peripheries of the second regions 8*b*, 10*b*, 12*b*, when viewed from the opposing direction of the pair of end faces 3*a*, 3*b*, but the present invention does not have to be limited to it. For example, they may be located on the side of one side face out of the four side faces 3*c*-3*f* or on the sides of two side faces out of the four side faces 3*c*-3*f*.

The element body 3 may be one without diffusion of the at least one element selected from the group consisting of alkali metals (e.g., Li, Na, and so on), Ag, and Cu.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A chip varistor comprising:

a varistor section comprised of a sintered body containing ZnO as a major component and configured to exhibit the nonlinear voltage-current characteristics;

a plurality of electroconductive sections comprised of sintered bodies containing ZnO as a major component and arranged with the varistor section in between, each electroconductive section having a first principal surface connected to the varistor section and a second principal surface opposed to the first principal surface; and a plurality of terminal electrodes connected to the plurality of electroconductive sections, wherein each of said terminal electrodes has a first electrode portion connected to the second principal surface, and a second electrode portion connected to the first electrode portion, wherein the varistor section includes a first region where at least one element selected from the group consisting of alkali metals, Ag, and Cu exists, and a second region extending between the first principal surfaces of the electroconductive sections and containing no element selected from the group consisting of alkali metals, Ag, and Cu, wherein each of said electroconductive sections includes a first region where at least one element selected from the group consisting of alkali metals, Ag, and Cu exists, and a second region extending between the first principal surface and the second principal surface and containing no element selected from the group consisting of alkali metals, Ag, and Cu, and wherein the first electrode portion is connected to the second region in the electroconductive section.

2. The chip varistor according to claim 1, wherein the first electrode portion is arranged so as to cover the second principal surface.

3. The chip varistor according to claim 1, wherein the first electrode portion is formed by co-firing an electroconductive paste containing a metal and containing no glass component, together with the varistor section and the plurality of electroconductive sections.

4. The chip varistor according to claim 1, wherein the varistor section contains at least one element selected from the group consisting of rare earth metals and Bi, as a minor component, and wherein the electroconductive sections are comprised of sintered bodies substantially containing none of the rare earth metals and Bi as a minor component.

5. The chip varistor according to claim 1, wherein the electroconductive sections are comprised of a composite material of a metal and a metal oxide.

6. The chip varistor according to claim 1, wherein the first region of the varistor section is located on the exterior surface side of the varistor section so as to surround an outer periphery of the second region of the varistor section, when viewed from a direction in which the varistor section is sandwiched in between the electroconductive sections.

7. The chip varistor according to claim 1, further comprising:

an electroconductive section arranged so that the first electrode portion is sandwiched in between the electroconductive sections.

* * * * *